United States Patent [19]

Tillmann

[11] 3,962,898

[45] June 15, 1976

[54] APPARATUS FOR THE MANUFACTURE OF WIRE

[75] Inventor: Klaus Erich Tillmann, Herborn, Germany

[73] Assignee: Berkenhoff & Drebes Gesellschaft mit beschrankter Haftung, Herborn, Germany

[22] Filed: Apr. 22, 1974

[21] Appl. No.: 463,041

[30] Foreign Application Priority Data

Apr. 21, 1973 Germany ..... 2320395

[52] U.S. Cl. ..... 72/279; 72/281; 72/286

[51] Int. Cl.[2] ..... B21C 1/04

[58] Field of Search ..... 72/274, 278, 286, 279, 72/289, 342, 41, 364; 148/11.5 R, 11.5 C, 13.2

[56] References Cited

UNITED STATES PATENTS

| | | | |
|---|---|---|---|
| 1,529,713 | 3/1925 | Picotin | 72/286 |
| 2,068,836 | 1/1937 | Zarafu | 72/279 |
| 2,119,516 | 6/1938 | Schuster | 72/286 |
| 2,370,973 | 3/1945 | Lang | 72/286 |
| 2,529,689 | 11/1950 | Hess | 148/13.2 |
| 2,676,123 | 4/1954 | Gregory | 148/11.5 R |
| 2,804,408 | 8/1957 | Gregory | 148/11.5 R |
| 3,316,068 | 4/1967 | Hose et al. | 148/11.5 C |
| 3,395,528 | 8/1968 | Lucht | 72/274 |
| 3,630,057 | 12/1971 | Strohmeier | 72/286 |
| 3,779,055 | 12/1973 | Goyffon | 72/46 |
| R20,067 | 8/1936 | Busey | 72/467 |

*Primary Examiner*—Milton S. Mehr
*Attorney, Agent, or Firm*—Woodhams, Blanchard and Flynn

[57] ABSTRACT

Apparatus for manufacture of wire. The apparatus includes structure for drawing the wire through a conventional wire drawing device and including a pull roller at the output point thereof. The wire then travels through a zone wherein an electric current is caused to flow through said wire while same is in motion therethrough for heating and annealing same, after which the wire is cooled and then directed through a further die for further shaping and cold working of same. A pull roller is provided at the output end of the last-named die for pulling the wire therethrough. The wire is finally wound onto a spool. By heating the wire as noted, same can travel through the heating zone at the same speed as through the dies and hence the operation is continuous and does not require intermediate winding and unwinding. Suitable coupling structure is provided for effecting proper speed relationships between the peripheries of the first-mentioned and second-mentioned pull rollers.

4 Claims, 1 Drawing Figure

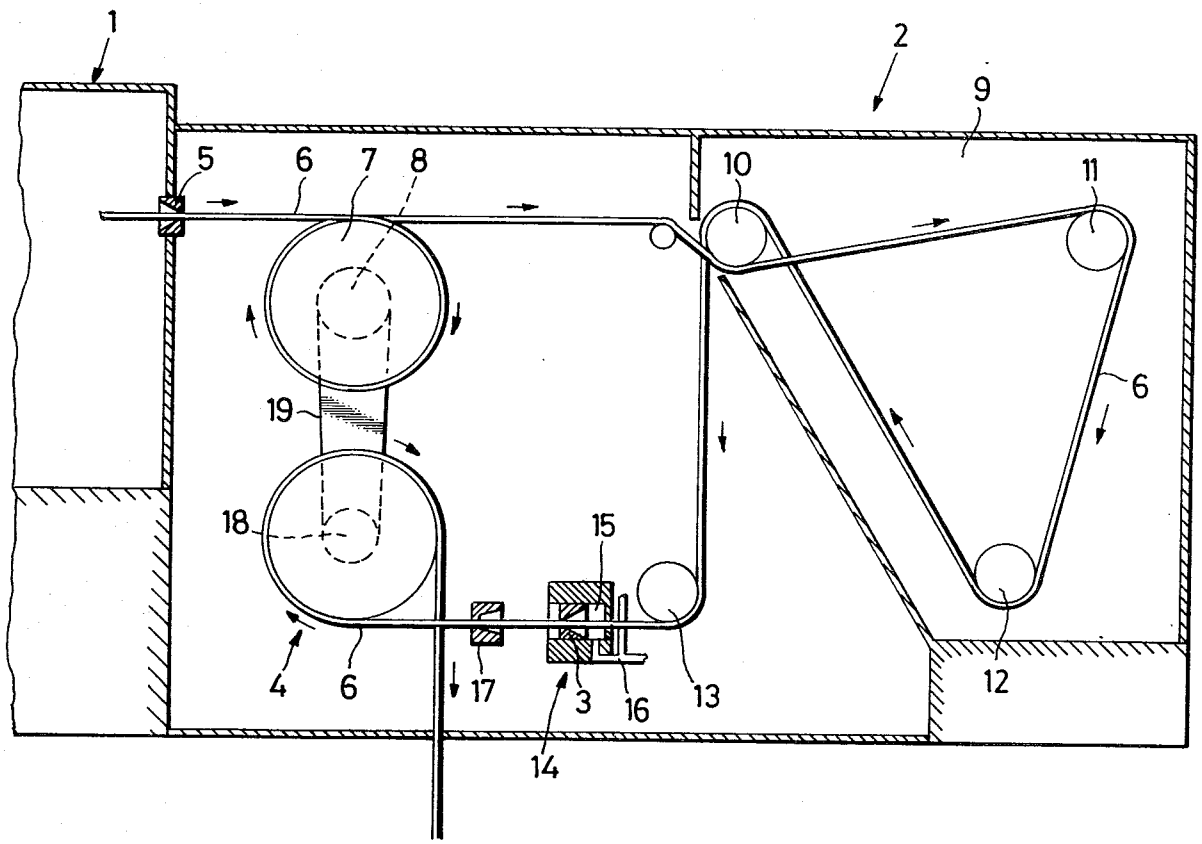
1
2
3
4
5
6
7
8
9
10
11
12
13
14
15
16
17
18
19

APPARATUS FOR THE MANUFACTURE OF WIRE

FIELD OF THE INVENTION

The invention relates to an apparatus for the manufacture of wire, preferably a nonferrous wire, such as brass, tombac, or bronze for Foudriner machine screens, in which there occurs first a cold drawing step, then a soft annealing step and finally another cold drawing step.

BACKGROUND OF THE INVENTION

To achieve high density values in wires, it is known (U.S. Pat. No. 2,804,408) first to cold draw the wire, to soft anneal same and finally to cold draw it again. During the last cold drawing the cross section is reduced in brass and tombac wires 8 to 10% and in the case of bronze approximately 30%. This after deformation causes hardening, which is advantageous in many cases, thus particularly also when used as paper machine screen, with respect to the wear behavior and with respect to a good reverse bending strength.

According to previous manufacturing practice, the wire was wound after the first cold drawing, then slowly unwound and guided through an annealing furnace and again wound, and thereafter subjected to the second cold drawing. This method is very time consuming because of the many winding and unwinding operations and the necessarily slow passage through the annealing furnace. It is therefore also expensive. In addition, breakdowns occur easily, mainly in pulling off the wire from the spools during the last cold drawing operation. Finally, during this drawing operation only a small deformation of a thin wire takes place and such could actually take place at very high speeds of for example 40 m./sec. under circumstances where the unwinding operation can occur only at a maximum speed of 15 m./sec. Thus, the drawing operation is very uneconomic.

SUMMARY OF THE INVENTION

The basic purpose of the invention is to further develop an apparatus of the type mentioned above so that the winding of the wire is no longer required between the individual method steps.

This purpose is attained according to the invention by guiding the wire after the cold drawing without intermediate spooling through an electric resistance heating zone at the speed at which it is pulled through the draw-die during the preceding cold drawing and then after leaving the electric resistance heating zone again cold drawing the wire without intermediate spooling and finally winding same thereafter only as a last step.

By using an electric resistance heating zone for soft annealing, it is possible to permit the various operating steps to operate continuously from one to the other, without the necessity for intermediate spooling. An electric resistance heating zone permits passage of the wire at the same speed at which it exits from the drawing means. The exit speed of the resistance heating zone again permits further cold drawing without intermediate spooling and thus at a high speed. This inventive method results in extraordinary work savings because it eliminates several operations which had previously been thought necessary. Also in the case of the inventive method there are fewer breakdowns than in known methods because the critical unwinding has been eliminated.

The second cold drawing operation can be carried out either dry or also wet. The wire can also be cooled after the last cold drawing, preferably by air.

The wire, which at this point is still round, can during the repeated cold drawing be flattened or otherwise profiled. The profiling can be chosen in such a manner that a cold deformation is achieved which also effects the desired work hardening.

An inventive apparatus for carrying out the above-described method steps is characterized by a drawing machine for the first cold drawing, having first drawing roller at its outlet, an electric resistance heating zone, a draw-die for the second cold drawing and a second drawing roller for pulling the wire through the draw-die. The use of a second drawing roller has the advantage that the tensile force does not need to be produced by the spooling apparatus which would lead to a winding of the wire which would be too tight and thus cause damage to the wire.

In an advantageous embodiment of the inventive apparatus, the second drawing roller is drivingly coupled with the first drawing roller, whereby the peripheral speed of the second drawing roller is greater than the peripheral speed of the first drawing roller. The different peripheral speeds are needed because during the last cold drawing there occurs a further cross-section reduction and thus an elongation of the wire.

Each drawing roller can have a separate drive shaft, wherein the drive shafts are coupled with one another, preferably through a drive belt. However, it is also possible to position the second drawing roller on the same shaft as the first drawing roller, and providing for the second drawing roller for achieving a higher peripheral speed a larger diameter than the first drawing roller. The last-mentioned construction is particularly simple, because additional shaft support means are avoided.

An air nozzle which surrounds the wire can be arranged between the draw-die and the second drawing roller. This apparatus serves to cool the wire after the last cold drawing. In addition to cooling of the wire, the air nozzle also provides for drying the finished wire prior to the winding thereof.

In the draw-die a lubricant container can be arranged through which the wire runs. A circulating mechanism for the liquid lubricant is advantageously associated with such lubricant container.

BRIEF DESCRIPTION OF THE DRAWINGS

The drawing schematically illustrates an apparatus for carrying out the method. The invention will be explained further hereinafter in connection with this drawing.

DETAILED DESCRIPTION

The main parts of the apparatus are a drawing machine 1, an electric resistance heating zone 2, a draw-die 3 and a drawing roller 4 which is positioned to follow said draw-die.

The drawing machine 1 has at its outlet a last drawing die 5 through which the wire 6 is pulled by means of a drawing roller 7. The wire 6 loops around the drawing roller 7 in a conventional manner and preferably several times. The drawing roller 7 is connected rotationally fixed to a drive shaft 8.

The electric resistance heating zone 2 has a housing 9, in which there are provided the rollers 10, 11 and 12. The wire 6 is guided successively over the rollers 10, 11, 12 and 10. The rollers 10, 11 and 12 have selected voltage differences (roller 10 has a voltage of zero), so that a strong current flows through the wire 6 which heats the wire as desired. The wire is cooled and dried between the rollers 12 and 10.

A guide roller 13 is arranged to follow the resistance heating zone and following said guide roller there is provided the draw-die 3. The draw-die 3 is arranged in a draw-die holder 14. The draw-die holder forms also a container 15 for lubricant, through which runs the wire 6. Lubricant is circulated through a return pipe 16.

An air nozzle 17 is arranged following the draw-die 3, which air nozzle surrounds the wire 6. The wire is pulled through the draw-die 3 by means of the drawing roller 4. The wire 6 loops around the drawing roller 4. The drawing roller 4 is positioned on a shaft 18 which is coupled with the shaft 8 of the drawing roller 7 by a drive belt 19. In this embodiment the belt pulley on the shaft 18 is slightly smaller than the one on the shaft 18 so that at the same diameter of the drawing rollers 7 and 4, the drawing roller 4 has a higher peripheral speed than the drawing roller 7.

The apparatus operates as follows:

The drawing roller 7 pulls the wire through the drawing die 5. From the drawing roller 7 the wire is pulled into the heating zone 2. This heating zone contains driven rollers which independently further drive the wire. The transporting of the wire over the guide roller 13, the draw-die 3 and the air nozzle 17 is effected by the drawing roller 4. The drawing roller is followed by a not-illustrated spooling apparatus which can wind the wire with any desired tension, because the spooling apparatus does not now need to exercise any tractive force for pulling the wire through the drawing die 3. This is carried out entirely by the drawing roller 4.

The inventive apparatus operates at a high speed. The operating speed of the resistance heating zone lies in the same order of magnitude as the operating speed of a drawing machine.

Although a particular preferred embodiment of the invention has been disclosed above for illustrative purposes, it will be understood that variations or modifications thereof which lie within the scope of the appended claims are fully contemplated.

I claim:

1. In an apparatus for the manufacture of wire, preferably of nonferrous wire such as brass, tombac, or bronze, for Foudriner machine screens, said apparatus having an input and an output, the improvement comprising first draw-die means adjacent said input for effecting a first cold drawing, said first draw-die means including a first drawing roller for pulling said wire through said first draw-die means, means defining an electric resistance heating zone for applying electrical energy directly to he wire immediately following said first drawing roller, the electrical resistance of said wire effecting a heating of said wire in response to said electrical energy to anneal said wire, second draw-die means for effecting a second cold drawing immediately following said electric resistance heating zone means, said second draw-die means including a second drawing roller for pulling said wire through said second draw-die means; and coupling means for drivingly coupling said second drawing roller to said first drawing roller, said coupling means having a characteristic of drawing said second drawing roller so that the peripheral speed thereof is higher than the peripheral speed of said first drawing roller.

2. An improved apparatus according to claim 1, wherein each of said first and second drawing rollers have a separate drive shaft; and wherein said coupling means includes belt means for drivingly coupling said two drive shafts.

3. An improved apparatus according to claim 1, wherein between said second draw-die means and said second drawing roller there is arranged an air nozzle which surrounds the wire.

4. An improved apparatus according to claim 1, wherein said second draw-die means includes a lubricant container through which said wire runs prior to said second drawing.

* * * * *